United States Patent [19]

May

[11] Patent Number: 4,566,823

[45] Date of Patent: Jan. 28, 1986

[54] CURB EXTRUSION APPARATUS WITH INTERCHANGEABLE MOLDS

[76] Inventor: George N. May, 9 Francis St., Cardiff, Newcastle, New South Wales, Australia

[21] Appl. No.: 551,879

[22] Filed: Nov. 15, 1983

[51] Int. Cl.[4] ..... E01C 19/48; B28B 3/24

[52] U.S. Cl. ..... 404/98; 425/62; 425/64; 425/190

[58] Field of Search ..... 425/62, 64, 182, 190; 249/2; 404/98, 96; 264/31, 33

[56] References Cited

U.S. PATENT DOCUMENTS

| | | | |
|---|---|---|---|
| 2,049,115 | 7/1936 | Hadley | 94/46 |
| 2,228,454 | 1/1941 | Hamilton | 180/1 |
| 2,410,271 | 10/1946 | Davidson et al. | 180/9.1 |
| 2,513,942 | 7/1950 | Johnson et al. | 56/21 |
| 2,707,422 | 5/1955 | Canfield | 425/64 |
| 2,853,250 | 9/1958 | Crom | 242/1 |
| 2,932,875 | 4/1960 | Butcher | 425/64 |
| 3,137,220 | 6/1964 | Smith | 425/62 |
| 3,261,272 | 7/1966 | Jennings, Jr. | 425/64 |
| 3,363,524 | 1/1968 | Catenacci | 94/46 |
| 3,507,015 | 4/1970 | Heatlie | 425/64 |
| 3,530,552 | 9/1970 | Calder | 425/64 |
| 3,585,911 | 6/1971 | Vlask | 94/46 |
| 3,600,773 | 8/1971 | Davis | 425/62 |
| 3,605,580 | 9/1971 | Miller | 94/46 |
| 3,733,140 | 5/1973 | James | 404/98 |
| 3,733,141 | 5/1973 | James, III | 404/98 |
| 3,826,411 | 7/1974 | Kalns | 425/64 |
| 3,915,584 | 10/1975 | Coho, Jr. et al. | 425/64 |
| 4,310,293 | 1/1982 | Eggleton | 425/62 |

FOREIGN PATENT DOCUMENTS

| | | | |
|---|---|---|---|
| 2130142 | 12/1972 | Fed. Rep. of Germany | 404/98 |
| 1476357 | 2/1967 | France . | |
| 1030997 | 5/1966 | United Kingdom | 19/50 |
| 1333040 | 10/1973 | United Kingdom | 19/40 |
| 2006311A | 5/1979 | United Kingdom | 404/98 |

*Primary Examiner*—Jay H. Woo
*Assistant Examiner*—James C. Housel
*Attorney, Agent, or Firm*—Workman, Nydegger & Jensen

[57] ABSTRACT

A manually operable curb extrusion device for extruding curb, barrier wall, gutter or the like from concrete, cement or some other moldable building material. The curb extrusion device has rapidly interchangeable extrusion molds and compacting members to provide for quick and efficient changing from one type of curbing to another. The building material is placed in a receiving hopper and falls into a compacting chamber where a power driven and reciprocating compacting member compacts the material into the extrusion mold where it is shaped before extrusion. The curb extrusion device is manually directed or steered along the desired course via an adjustable steering mechanism.

14 Claims, 8 Drawing Figures

CURB EXTRUSION APPARATUS WITH INTERCHANGEABLE MOLDS

This invention relates to machines and devices used to form curbing and the like, and more particularly, it relates to portable, manually steerable curb extrusion machines.

BACKGROUND OF THE INVENTION

Great advances have been made in the building industry with respect to forming curbs, gutters, curbs and channels, and the like. Not many years ago, it was necessary to assemble wooden forms by hand, a section at a time, into the desired curb shape. This assembly of forms required a considerable amount of skill and preparation time. Further, once the concrete or cement had been poured into the prepared form and properly cured, the wooden forms, usually reusable, were disassembled and then reassembled for another section of the curbing. This process consumed much time and consequently was very expensive.

Within the last few decades, slip-form curb making machines have been developed which produce curbs, barrier walls and the like. Typically, to be economically feasible, these curb making machines were large bulky machinery utilized almost exclusively for highway or roadway use where vast distances of curbing or barrier walls were being formed. Operation of such machinery may require several workmen and substantially level surfaces upon which the curbing is to be formed.

Slip-form curb making machines are complex machines having many working parts. Such machines usually comprise a hopper for receiving and storing the concrete, cement, or some other building material; an extrusion mold which shapes the material before it is extruded; a feed mechanism for forcing the material into the extrusion mold; and some type of steering mechanism. Some of the curb machines are vehicles in which the operator rides on the vehicle itself while steering it in a manner similar to a tractor or a truck. Other curb making machines are designed to follow a railing or track which is prepared in advance. Some of the curb making machines are propelled by an engine or motor. Others are propelled by a winch which drags the vehicle on a cable. Still others are set on wheels or sled-like runners and are propelled by the pushing action of the feed mechanism compacting fresh material against the extruded curbing.

Several types of feed mechanisms have been used in curb making machines. Auger screws have been used to deliver the concrete, cement, or other building material to the extrusion mold. Piston and plunger assemblies and reciprocating ramming plates have also been used to deliver and compact such materials. Such feed mechanisms serve to vibrate or agitate the building material being used and to compact such material so as to fill the mold and to eliminate undesirable voids and weaknesses in the material.

Only recently have small hand operated, power driven curb making machines been developed which can be feasibly and economically used for yard use or for small applications where the large highway curb machines are impractical. The forerunner of such machines were small wheel-barrow like devices which required manpower to propel the device along the ground and to operate the plunger or ramming plate. Thus, operation of such devices was extremely fatiguing and required a two-step procedure; the device was moved and positioned and then the plunger was thrust against the building material which had been placed in the device's hopper by the operator or another workman. With the advent of power driven curb making machines, an operator's primary responsibility became the steering of the device over the desired course. The power driven devices are propelled along the ground by the pushing action of the engine or motor driven plunger or ramming plate against the building materials in the molding region.

One concern experienced with the making of curbs or barrier walls for smaller applications was the strength of the curb produced. Most extrusion type curb making machines, particularly those of the small, hand operated variety, did not enable the operator to strengthen the curb with internal reinforcement bars or wires. Ultimately, however, a hand operated machine with a power driven plunger was equipped with slots and/or apertures in the ramming plate which permitted the operator to introduce reinforcement bars or wires into the material being molded into a curb. The reinforcement problem is no longer a concern in curb making for smaller applications, however, because various fibrous materials, such as polypropylene fiber, can be added to the mixture of concrete, cement, or other building material which provide the material with the needed strength. Thus, the use of reinforcement bars or wires, for practical purposes, can be eliminated, thereby eliminating the need for a device that permits the introduction of reinforcement bars into the material.

The advancements and developments in the art of curb making have reduced the time consumed and the energy and manpower expended, but there is still room for improvement. It is still extremely time consuming to change from one curb configuration to another, for example, a change from a curb and gutter to a driveway. With many curb making machines, the curb configuration cannot be changed. In those cases the concrete or cement must be worked by hand to the desired configuration or another machine with the desired mold configuration must be used. Other curb making machines have features which can modify the configuration of the extruded concrete or cement without changing the extrusion mold. However, the modifications possible are limited and the components needed to provide the ability to modify add bulk and weight to the curb making machine. Some of the curb making machines have removable extrusion molds which can be interchanged so that the desired mold can be attached to the machine. But, the removal and changing of an extrusion mold is complex and has required considerable time and effort. Usually, such an exchange requires the disassembly of much of the machine, and in some cases, the disassembly of almost the entire feed mechanism. Moreover, the versatility of exchangeable extrusion molds has not been heretofore available in the small, hand operated curb making machines.

Accordingly, it would be an improvement in the art to provide an apparatus which would have the versatility of interchangeable extrusion molds that could be easily and quickly exchanged. It would also be an improvement in the art to provide interchangeable compacting plates or members to correspond to the various extrusion molds, particularly if such plates or members could also be easily and quickly exchanged. Further, it would be an improvement in the art to provide such versatility for the smaller, hand operated curb making machines that are used for yard purposes and to reach areas ordinarily inaccessible to the larger highway machines. Such apparatus are disclosed and claimed herein.

SUMMARY OF THE INVENTION

The present invention is directed to a small hand operated, power driven curb forming device for use in one's yard or for smaller applications. The novel curb extrusion apparatus of the present invention comprises a power driven feed mechanism with quickly interchangeable compacting members, a hopper, quickly interchangeable extrusion molds, and a steering mechanism with wheels or some other means of support and transport.

The hopper is of the conventional type open at its top and at its bottom where it communicates with a compacting chamber which is adjacent the extrusion mold. The concrete, cement or other building materials placed into the hopper fall under the force of gravity into the compacting chamber. From there, the material is pushed into the extrusion mold where it is shaped before it is extruded.

The steering mechanism of the present invention can be any of a number of suitable steering mechanisms. However, for simplicity and economy of explanation only a wheels and steering lever mechanism will be described herein. Such a steering mechanism has one or more wheels each mounted on a stub axle and connected to one or more rigid arms which are maneuvered by an attached lever.

The interchangeable extrusion molds each comprise a substantial tunnel configuration open at its forward and rearward ends and at its bottom, an attachment plate, and a support means. Each extrusion mold has an upper portion and side walls shaped to correspond to the surface shape of a curb, barrier wall, gutter or the like. The desired extrusion mold is positioned and affixed adjacent the hopper and compacting chamber by securing the attachment plate to the hopper and the support means to a support bar provided for that purpose. An extrusion mold can be interchanged with another mold by disengaging the attachment plate and support means, removing one mold, replacing it with another mold, and then securing the new mold into position.

When an extrusion mold is changed and replaced with another mold having a different configuration, it is advisable that the feed mechanism be modified to employ a compacting member with a configuration compatible with the newly installed mold. With the present invention, this can be done quite easily, because the feed mechanism has a clamp assembly and each compacting member has prongs which fit into and can be secured by the clamp assembly. An operator need only loosen the clamp assembly sufficiently to release the compacting member. A new compacting member can then be positioned within the clamp assembly and the clamp assembly tightened to secure the disposition of the compacting member.

Thus, the present invention enables the user not only to change the extrusion mold, but also to change the compacting member with a minimum of effort and complexity. Very little time or expense is involved in such an exchange. Consequently, a great deal of versatility is introduced into the small, hand operated curb forming apparatus of the present invention without adding complexity or expense.

It is, therefore, a primary object of the present invention to provide a versatile apparatus for forming curbs, gutters, barrier walls and the like which is manageable in size and easy to maneuver.

Another object of the present invention is to provide an apparatus that is power driven such that it compacts the concrete, cement, or other building material and the compacting action propels the apparatus along its course with minimal steering by an operator.

It is also an object of the present invention to provide an apparatus for making curbs and the like which has easily interchangeable extrusion molds.

A further object of the present invention is to provide an apparatus for making curbs and the like which has easily interchangeable compacting members, such members having configurations compatible with various extrusion molds.

These and other objects and features of the present invention will become more fully apparent from the following description and appended claims taken in conjunction with the accompanying drawings.

DETAILED DESCRIPTION OF THE PREFERRED EMBODIMENTS

Figure 1:
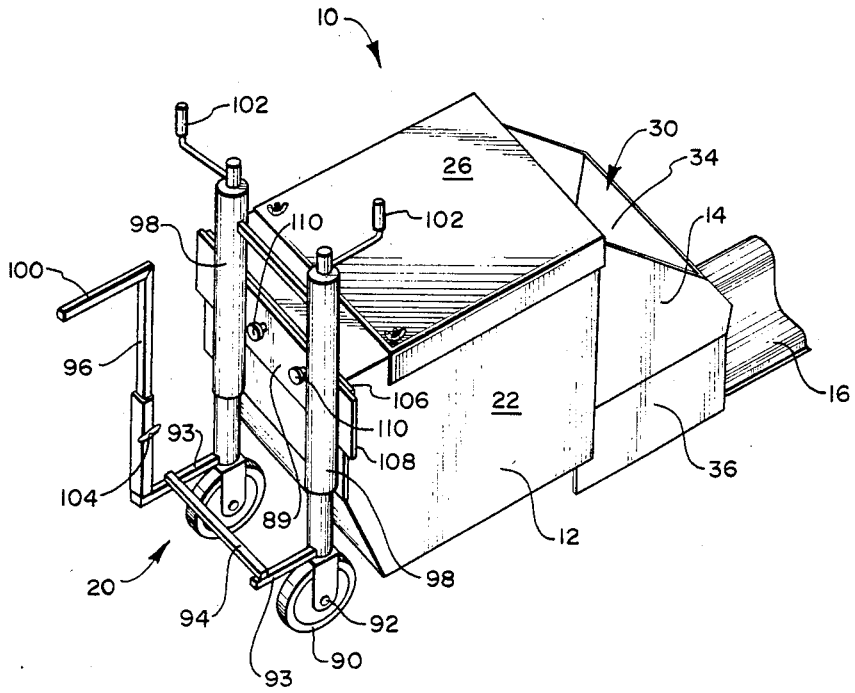
FIG. 1 is a perspective view of the curb extrusion apparatus, showing one presently preferred embodiment of the present invention.

It will be readily appreciated that the components of the present invention, as generally described and illustrated in the figures herein, could be arranged and designed in a wide variety of different configurations. Thus, the following more detailed description of the embodiments of the present invention, as represented in FIGS. 1–8, is not intended to limit the scope of the invention, as claimed, but is merely representative of presently preferred embodiments of the invention.

Reference is now made to the drawings wherein like parts are designated with like numbers throughout.

The manually maneuverable curb extrusion apparatus 10 of the present invention (illustrated generally in FIGS. 1–4) comprises a body 12 having a hopper 14, an interchangeable extrusion mold 16, a power driven feed mechanism 18 and a steering assembly 20. Herein manually maneuverable shall mean light-weight and non-bulky, such that one or two persons can easily lift, maneuver, manipulate, or steer the device.

The body 12 houses the power driven feed mechanism 18 and comprises a housing 22 with a mount 24, a lid 26, a hopper 14, and support structure 28. The housing 22 shields the feed mechanism 18 from dust, dirt and grime during use. The feed mechanism 18 is supported by and secured to the mount 24 such that it is internal of the housing 22. The lid 26 is removably secured to the housing 22 such that it can be readily removed to provide rapid access to the feed mechanism 18 should the user so desire.

Next adjacent the housing 22 is the hopper 14 which is disposed toward the extrusion end of the curb extrusion apparatus 10. The hopper 14 has an open mouth 30 and an open bottom 32 and defines a compartment 34 for placing and temporarily storing the material to be extruded, whether that material is concrete, cement or some other building material. Subtending the hopper 14 is a skirt 36 which defines a compacting chamber 38. When the curb extrusion apparatus 10 is in operation, the material to be extruded drops, under the force of gravity, from the hopper compartment 34 into the compacting chamber 38 to be compacted.

The interchangeable extrusion mold 16 is secured to the support structure 28 adjacent the extrusion end of the compacting chamber 38. The support structure 28 comprises bracing wings 29 and an anchoring bar 31. The bracing wings 29 extend outwardly from the hopper 14 and are held in spaced relationship by the anchoring bar 31. The anchoring bar 31 is the support from which the extrusion mold 16 is suspended.

Each extrusion mold 16 has a different cross-sectional configuration so as to shape the material extruded into different shapes. See for example the different extrusion mold 16 shapes illustrated in FIGS. 5 and 7.

Figure 2:
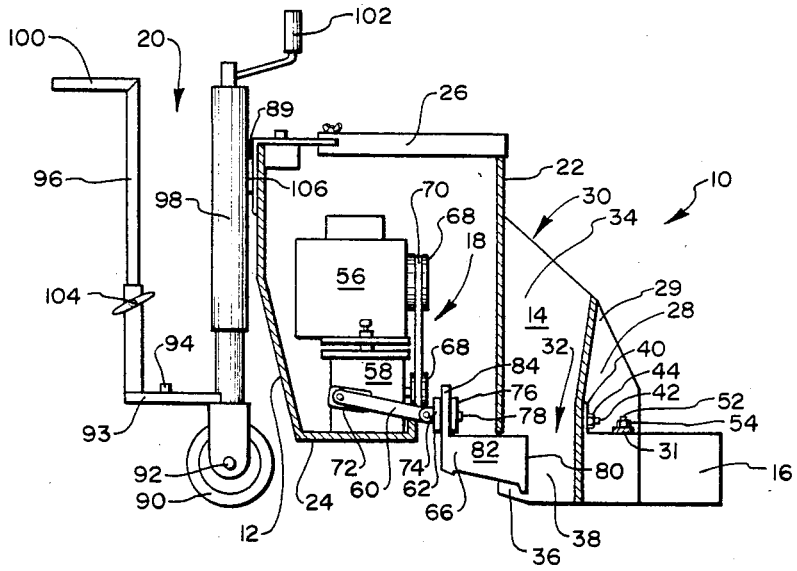
FIG. 2 is a side elevational view of the curb extrusion apparatus shown in partial section so as to expose to view a preferred power driven feed mechanism of the present invention, wherein the feed mechanism is in its fully contracted position.
Figure 5:
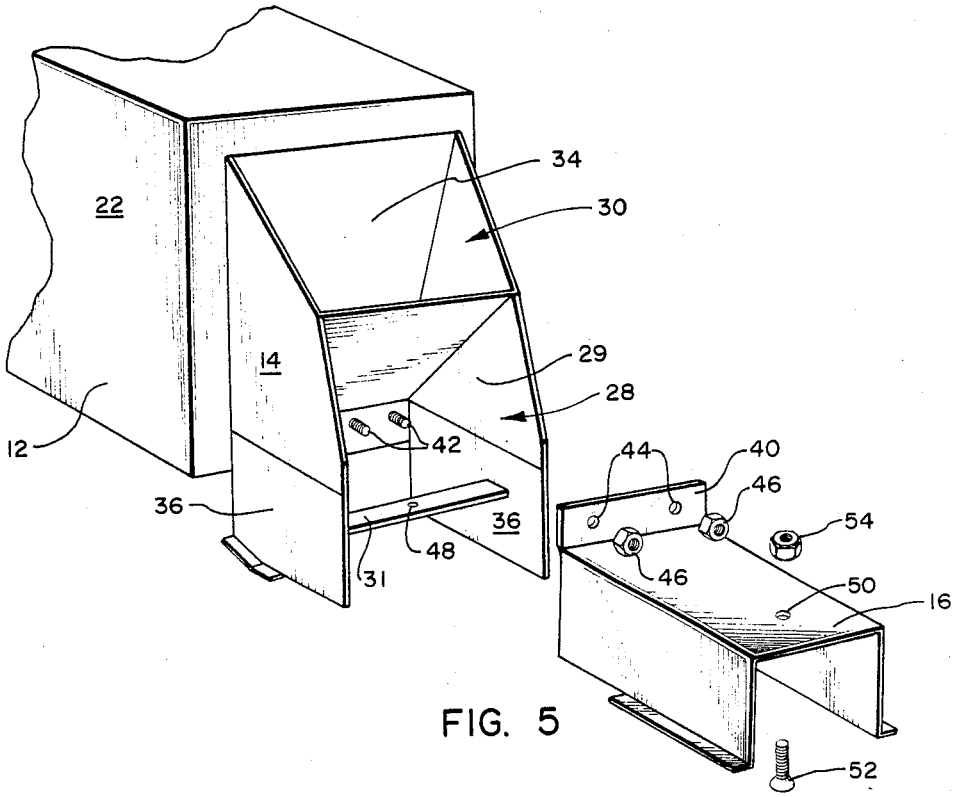
FIG. 5 is an exploded, partially cut-away view of the extrusion end of the curb extrusion apparatus illustrating the simple manner in which an extrusion mold is removed.
Figure 6:
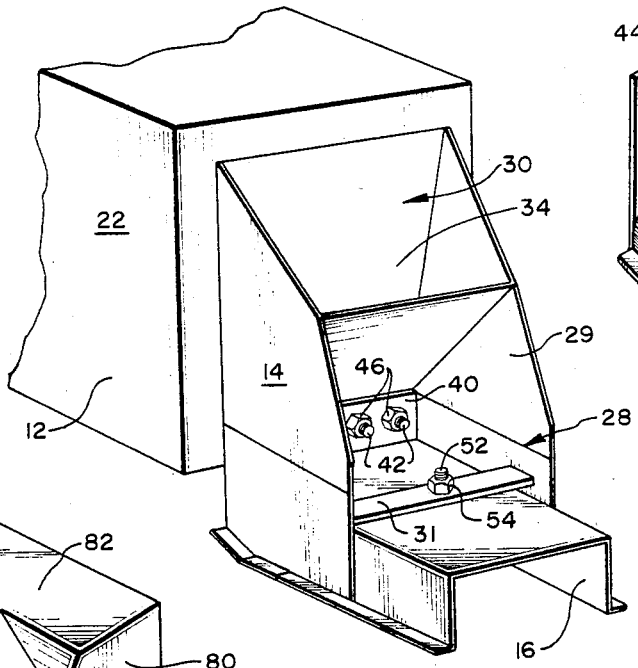
FIG. 6 is a partially cut-away view of the extrusion end of curb extrusion apparatus illustrating the manner in which an extrusion mold is secured to the apparatus.

Each interchangeable extrusion mold 16 is adapted to be received by the support structure 28 and has an attachment plate or flange 40 which can be securely attached to the hopper 14 (see FIG. 2). This attachment can be accomplished by any suitable means, however, it is preferred that the attachment be by nut and bolt assembly as illustrated in FIGS. 5 and 6. Bolts or bolt stubs 42 are affixed to the lower external portion of the hopper 14 so that they protrude outwardly. It is preferred that heads of the bolts 42 not protrude into the compartment 34 within the hopper 14 because that will cause an obstacle to which the concrete or the like may cling or upon which it may get hung up. The attachment plate 40 has holes 44 in register with the protruding bolts 42 through which the bolts 42 may be passed and secured by nuts 46 (see FIG. 6). This secures the extrusion mold 16 from horizontal movement. To secure the extrusion mold 16 from undesirable vertical movement, the mold 16 is secured to the anchoring bar 31 of the support structure 28 which extends above and across the extrusion region. The anchoring bar 31 has an aperture 48 which aligns with a like mold aperture 50 in the extrusion mold 16. When the apertures 48 and 50 are aligned, a bolt 52 may be passed therethrough and secured by a nut 54. With this embodiment it is imperative that the head of the bolt 52 be flush with the interior of the mold 16 so that undesirable streaks or grooves are not carved into the extruded curb.

Another preferred embodiment has the bolt 52 secured to the exterior of the extrusion mold 16 (see FIG. 7) where the mold aperture would otherwise be located. The bolt 52 can be secured by welding or some other suitable means. With this embodiment, there is no danger of causing streaks or grooves in the curbing because the interior of the mold 16 remains smooth.

The described attachment means using nuts and bolts offers some salient advantages. For example, most importantly, an extrusion mold 16 may be interchanged with a different extrusion mold 16 in a few moments without disassembling the structure of the curb extrusion apparatus 10. The nuts 46 and 54 are quickly removed. The extrusion mold 16 being used is removed. A new mold 16 is placed for attachment and the nuts 46 and 54 are tightened. Also, since the interchangeable part, the extrusion mold 16, is a relatively inexpensive component of the apparatus 10, the owner or operator can have several different types of extrusion molds 16 without incurring prohibitive expense. This affords great versatility to the apparatus because many types of curbing are available at reasonable expense.

The power driven feed mechanism 18 comprises an engine or motor 56, a reciprocator 58, a driven arm 60, a connector or clamp assembly 62, a sliding support assembly 64, and a compacting member 66. The engine or motor 56 may be of any suitable conventional type. It can be a small internal combustion gasoline engine or an electrically or hydraulically driven motor. However, to accommodate an apparatus 10 designed particularly for smaller yard applications, it is preferred that the motor 56 be electrically driven and that it be suitably connected to a source of electrical power.

Figure 3:
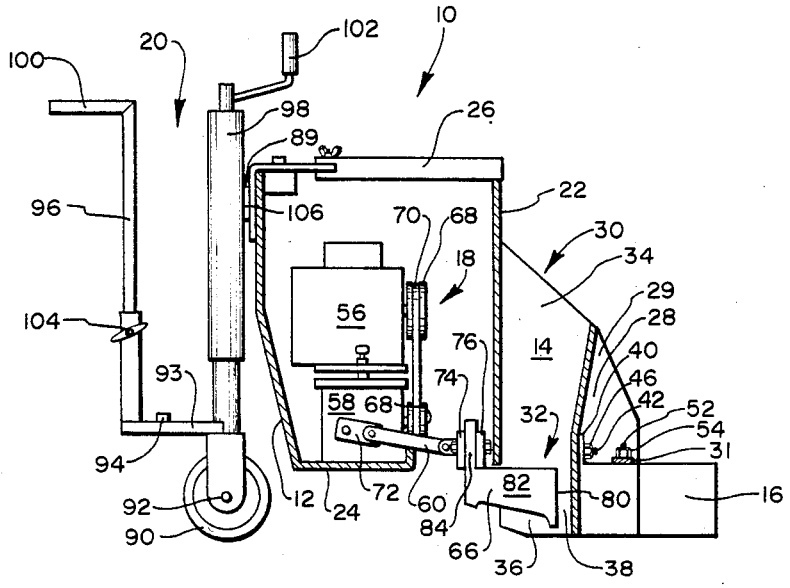
FIG. 3 is a side elevational view of the curb extrusion apparatus shown in partial section so as to expose to view a preferred power driven feed mechanism in its fully extended position.

The motor 56 is connected to the reciprocator 58 via pulleys or sprockets 68 and drive belt or chain 70. The reciprocator 58 converts the rotation imparted by the motor 56 by the pulleys 68 and drive belt 70 into a reciprocating force which proels the drive arm 60. The rotation is converted to a reciprocating force by a drive cam 72 which is connected to the drive arm 60. As the drive cam 72 rotates about its axis the connected drive arm 60 is thrust forward and back. FIG. 2 shows the drive arm 60 in its fully retracted position. FIG. 3 shows the drive arm in its fully extended position. It is this reciprocating force that compacts the concrete, cement or other building material.

Figure 7:
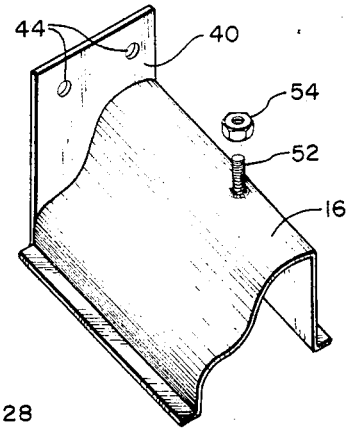
FIG. 7 is a perspective view of another preferred embodiment of an extrusion mold.
Figure 8:
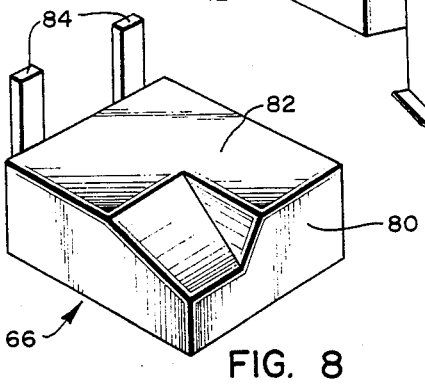
FIG. 8 is a perspective view of another preferred embodiment of a compacting member such as would be compatible with the extrusion mold shown in FIG. 7.

The drive arm 60 is affixed to a clamp assembly 62 which comprises a forward clamp plate 74 and a rearward clamp plate 76 joined in clamping engagement by one or more bolt and nut assemblies 78. The clamp plates 74 and 76 are disposed parallel and are drawn closer to each other by tightening the bolt and nut assemblies 78. The clamp assembly 62 is adapted for receiving the compacting member 66 in securing engagement. The clamp assembly 62 affords another great advantage to the apparatus 10 of this invention. Namely, the clamp assembly 62 enables the user to interchange compacting members 66 in just moments. The user need only loosen the bolt and nut assemblies 78, remove the compacting member 66 being used, replace it with another compacting member 66, and tighten the bolt and nut assemblies 78. This enables the user to change the compacting member 66 to one that is compatible with and complementary to the extrusion mold 16 to be used. For example, the compacting member 66 shown in FIG. 8 is complementary to and should be used for the extrusion mold 16 shown in FIG. 7. A compacting member 66, with a flat rectangular impacting surface 80 (as shown in FIG. 2) is complementary to and should be used with an extrusion mold 16 such as is shown in FIGS. 5 and 6.

Moreover, the clamp assembly 62 described offers both vertical and lateral adjustment to the compacting member 66. In use, the constant pounding of the reciprocating motion can cause a compacting member 66 to become misaligned or bent. The vertical and lateral adjustment provided by the connecting assembly 62 enables the user to make adjustments to compensate accordingly. This again increases the versatility as well as the useful life of the apparatus 10.

The compacting member 66, as mentioned above, may have any of a number of different configurations; however, the compacting members 66 of the present invention are preferably comprised of a solid body 82, one or more prongs 84 which protrude upwardly from the solid body 82, and a vertically flat impacting surface 80. The solid body 82 carries the ramming force which compacts the concrete, cement or other material as the compacting member 66 reciprocates back and forth. The prongs 84 provide the connection between the compacting member 66 and the clamp assembly 62. The prongs 84 are sandwiched in clamping engagement between the clamp plates 74 and 76 and are secured into position by tightening the bolt and nut assemblies 78. As set forth above, the vertical and lateral disposition of the compacting member 66 may be adjusted by adjusting the position of the prongs 84 within the clamp assembly 62 before tightening it securely.

The impacting surface 80 is preferred to be flat and to have a surface shape which corresponds to whichever extrusion mold 16 is in position for use. This assures the most efficient use of the apparatus 10. A compacting member 66 having an impacting surface 80 as illustrated in FIG. 8 will operate more efficiently with an extrusion mold as shown in FIG. 7 than will a compacting member 66 with a rectangular impacting surface 80, because it will not compact the concrete, cement or other material against the portion of the attachment plate 40 that helps define the configuration of the extrusion mold 16.

Figure 4:
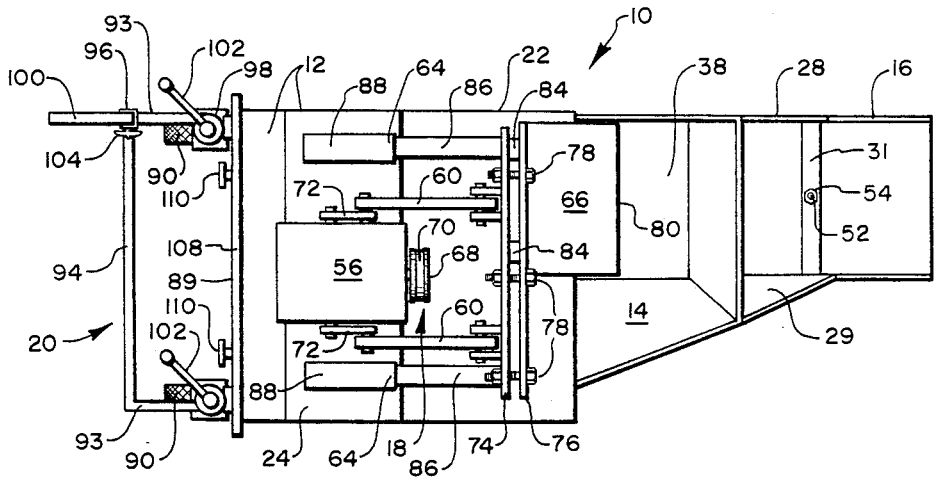
FIG. 4 is a top plan view of the curb extrusion apparatus shown with the lid removed from the main body of the apparatus to expose to view the power driven feed mechanism.

The sliding support assembly 64 which is shown in FIG. 4 is not shown in FIGS. 2 and 3 in order that the reciprocating motion of the power arm 60 can be clearly shown. The sliding support assembly 64 comprises a rod 86 which is attached to the clamp assembly 62 and which slides longitudinally within a hollow guide tube 88. The sliding engagement is lubricated to reduce friction. The sliding support assembly 64 assures that the drive arms 60 and clamp assembly 62 remain aligned and directs the reciprocating force on a horizontal plane so as to reduce undesirable vibration and waste of force.

The steering assembly 20 can be any of a number of suitable conventional steering mechanisms ranging from mere handle bars to a sophisticated steering wheel with responding support wheels. However, the steering assembly 20, best illustrated in FIG. 1, is preferred. The preferred steering assembly 20 is attached to the body 12 of the curb extrusion apparatus 10 by an adjustable fastener assembly 89 and comprises a pair of wheels 90 mounted on stub axles 92 and joined for coordinated movement by rigid arms 93 to a cross bar 94, a steering lever 96, and vertical adjustment jacks 98. The steering lever 96 has a handle 100 and is connected to the cross bar 94 such that when the handle 100 is disposed either to be right or the left the cross bar 94 and rigid arms 93 move to direct the wheels 90 accordingly. The vertical adjustment jacks 98 are of a conventional type which raise or lower the body 12 in relation to the ground and are activated by rotating spin handles 102. This vertical adjustment enables the apparatus 10 to travel over terrain which is not level or smooth. The steering lever 96 is also vertically adjustable (see FIG. 1) by using a sliding adjustment secured by a wing nut 104.

The adjustable fastener assembly 89 preferred comprises a guide rail 106 securely fastened to the body 12 of the curb extrusion apparatus 10, a slide channel 108 attached to the jacks 98 which slidably engages the guide rail 106, and one or more tightening knobs 110. The guide rail 106 fits into the slide channel 108 so as to restrict vertical displacement of the steering assembly 20 but permits the slide channel 108 to slide laterally. This capability of lateral movement enables the user to adjust the position of the steering assembly 20 to avoid obstacles and to permit extrusion of a curb close to obstacles such as trees, walls, sprinkling systems, etc. The user need only loosen the tightening knobs 110, shift the steering mechanism 20 laterally out of the way, tighten the tightening knobs, and proceed with curb extrusion.

To operate the curb extrusion apparatus 10 of the present invention, the apparatus 10 is positioned on the course for which curbing is desired. The motor 56 is started which causes the drive arm 60 to reciprocate. This drives a compacting member 66, in reciprocating motion to and fro within the compacting chamber 38.

The material to be extruded is placed in the hopper 14. This material may be concrete, cement or some other material and is usually a dry, low slump mix that will readily take and hold a shape, without excessive drying time. In order to eliminate the need for reinforcement bars or wires, it is preferred that the material contain a polypropylene fiber which is known and commonly used in the building industry. The material placed in the hopper 14 falls through the bottom 32 of the hopper 14 and into the compacting chamber 38 when the drive arm 60 retracts the compacting member 66. The compacting member 66 then rams the material within the compacting chamber 38 with compacting force as the compacting member 66 returns to its fully extended position. This compacts the material, concrete or the like, into the extrusion mold 16 and forms the material into the contour defined by the mold 16.

As more material is compacted into the extrusion mold 16, curbing extrudes out of the mold 16 along the ground. Thus, by adding more material for compacting, the apparatus is propelled along the ground leaving behind extruded curbing. The course of the curbing is determined by the manner and direction in which the user steers the apparatus along the ground. To avoid obstacles, the user may slide the steering mechanism laterally or adjust its vertical position as described above.

Also, if the user should desire to change the configuration of the curbing (such as for a driveway or walkway), he can quickly change the extrusion mold 16 and, if necessary, the compacting member 66. The change is relatively simple and requires no particular skills and a short period of time.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A manually maneuverable curb extrusion apparatus for receiving concrete, cement or other building materials and for molding curbs, barrier walls, and gutters from such materials, comprising:

a body frame having a hopper with an open top and an open bottom portion for receiving the concrete, cement or other building material;

a compacting chamber adjacently subtending the open bottom portion of said hopper and communicating therewith such that the concrete, cement or other building material falls under the force of gravity from said hopper into said compacting chamber;

at least one extrusion mold having open forward and rearward ends and an open bottom; each said extrusion mold for disposition adjacent to and communicating with said compacting chamber; each said extrusion mold being removable from disposition adjacent said compacting chamber and being interchangeable with another extrusion mold;

means for interchangeably securing, one at a time, said extrusion molds adjacent said compacting chamber;

a power driven feed mechanism operating from a power source comprising at least one reciprocating arm which reciprocates from a first position to a second position, a compacting member, and a connector for attaching said reciprocating arm to said compacting member such that the power driven reciprocating action of said reciprocating arm is imparted to said compacting member; said compacting member being at least partially disposed within said compacting chamber and engaging concrete, cement or other building material within the compacting chamber in compacting engagement when said reciprocating arm is in its first position and permitting cement or other building material to fall into said compacting chamber when said reciprocation arm is in its second position;

said compacting member further being removable from said connector and being interchangeable with another compacting member, wherein said connector adjustably permits the vertical and lateral disposition of said interchanged compacting member prior to tightening said connector to said interchanged compacting member; and means for steering said body frame.

2. A curb extrusion apparatus as set forth in claim 1 wherein said interchangeable securing means comprises an attachment plate rigidly connected to said extrusion mold; a releasable plate fastener for securely connecting said attachment plate to said body frame; a support member portion of said body frame; and a releasable support fastener for securely connecting said extrusion mold to said support member portion of said body frame.

3. A curb extrusion apparatus as set forth in claim 2 wherein said releasable plate fastener and said releasable support fastener are nut and bolt assemblies.

4. A curb extrusion apparatus as set forth in claim 2 wherein said releasable plate fastener and said releasable support fastener comprise not more than three nut and bolt assemblies.

5. A curb extrusion apparatus as set forth in claim 1 wherein each compacting member has an impact surface shaped substantially complementary to the cross-sectional shape of at least one extrusion mold.

6. A curb extrusion apparatus as set forth in claim 1 wherein said connector is a clamp assembly and each compacting member has at least one prong insertable into the clamp assembly whereby the vertical and lateral disposition of said compacting member is adjustable prior to tightening the clamp assembly about said prong.

7. A curb extrusion apparatus as set forth in claim 1 wherein said steering means comprises at least one steerable wheel connected to a lever, the direction of said lever determining the directional disposition of said steerable wheel.

8. A manually maneuverable curb extrusion apparatus for receiving concrete, cement or other building material and for molding curbs, barrier walls, and gutters from such materials, comprising:

a body frame having a hopper with an open top and an open bottom portion for receiving the concrete, cement or other building material;

a compacting chamber adjacently subtending the open bottom portion of said hopper and communicating therewith such that the concrete, cement or other building material falls under the force of gravity from said hopper into said compacting chamber;

an extrusion mold having open forward and rearward ends and an open bottom; said extrusion mold being disposed adjacent to and communicating with said compacting chamber;

a power driven feed mechanism operating from a power source comprising at least one reciprocating arm which reciprocates from a first position to a second position, at least one compacting member, and a releasable connector for releasably attaching said reciprocating arm to said compacting member such that the power driven reciprocating action of said reciprocating arm is imparted to said compacting member and for releasing said compacting member to enable the interchangeable attachment of another compacting member; said compacting member being at least partially disposed within said compacting chamber when connected to said reciprocating arm; said compacting member and engaging concrete, cement or other building material within the compacting chamber in compacting engagement when said reciprocating arm is in its first position and permitting uncompacted concrete, cement or other building material to fall into said compacting chamber when said reciprocating arm is in its second position;

said compacting member further being removable from said connector and being interchangeable with another compacting member, wherein said connector adjustably permits the vertical and lateral disposition of said interchanged compacting member prior to tightening said connector to said interchanged compacting member; and means for steering said body frame.

9. A curb extrusion apparatus as set forth in claim 8 wherein said releasable connector is a clamp assembly and each compacting member has at least one prong insertable into the clamp assembly whereby the vertical and lateral disposition of said compacting member is adjustable prior to tightening the clamp assembly about said prong.

10. A curb extrusion apparatus as set forth in claim 8 wherein said steering means comprises at least one steerable wheel connected to a lever, the direction of said lever determining the directional disposition of said steerable wheel.

11. A system for providing rapid interchangeability of extrusion molds in a manually maneuverable curb extrusion device to correspond with interchangeable compacting members comprising:

a plurality of extrusion molds each having a different cross-sectional configuration corresponding to a plurality of compacting members each having a different cross-sectional configuration, open forward and rearward ends, and an open bottom and each having an attachment plate rigidly connected thereto;

means for releasably securing said compacting members to the curb extrusion device comprising a releasable connector to receive a prong of a selected compacting member in releasable engagement wherein said releasable connector is a clamp assembly in which said prong is insertable whereby the vertical and lateral disposition of said compacting member is adjustable prior to tightening the clamp assembly about said prong; and means for interchangeably securing, one at a time, said extrusion molds to the extrusion end of the curb extrusion device so as to correspond with the selected interchangeable compacting member, the curb extrusion device having a support member disposed to engage said extrusion mold when in its attachment position, and said interchangeable securing means comprising a releasable plate fastener for securely connecting said attachment plate to the curb extrusion device and a releasable support fastener for securely connecting said extrusion mold to said support member.

12. A system as set forth in claim 11 wherein said releasable plate fastener and said releasable support fastener are nut and bolt assemblies.

13. A system as set forth in claim 12 wherein said releasable plate fastener and said releasable support fastener comprise not more than three nut and bolt assemblies.

14. A system for providing rapid interchangeability of compacting members in a manually maneuverable curb extrusion device comprising:

a plurality of compacting members each having at least one prong and an impact surface configuration different from each other;

a reciprocating force source to which said compacting members are connectable;

means for interchangeably securing, one at a time, said compacting members to said reciprocating force source comprising a releasable connector to receive said prong of said compacting member in releasable engagement wherein said releasable connector is a clamp assembly in which said prong is insertable whereby the vertical and lateral disposition of said compacting member is adjustable prior to tightening the clamp assembly about said prong.

* * * * *

UNITED STATES PATENT AND TRADEMARK OFFICE

CERTIFICATE OF CORRECTION

PATENT NO. : 4,566,823

DATED : January 28, 1986

INVENTOR(S) : George N. May

It is certified that error appears in the above-identified patent and that said Letters Patent is hereby corrected as shown below:

Column 6, line 38, "proels" should be --propels--

Column 7, line 67, "to be" should be --to the--

Signed and Sealed this

*Seventeenth* Day of *June 1986*

[SEAL]

*Attest:*

DONALD J. QUIGG

*Attesting Officer*

*Commissioner of Patents and Trademarks*